US005213089A

United States Patent [19]

DeLuca

[11] Patent Number: 5,213,089

[45] Date of Patent: May 25, 1993

[54] TOY GUN

[75] Inventor: Donald A. DeLuca, Barrington, R.I.

[73] Assignee: Hasbro, Inc., Pawtucket, R.I.

[21] Appl. No.: 742,324

[22] Filed: Aug. 8, 1991

[51] Int. Cl.[5] ..... F41B 7/08

[52] U.S. Cl. ..... 124/29; 124/31; 124/32

[58] Field of Search ..... 124/16, 26, 27, 29, 124/31, 32, 41.1, 45, 48, 82, 83, 84, 85; 42/1.08, 65, 69.01, 69.02, 105; 89/27.14

[56] References Cited

U.S. PATENT DOCUMENTS

| | | | |
|---|---|---|---|
| 1,291,113 | 1/1919 | Pewther | 124/27 |
| 1,311,934 | 8/1914 | Weinholt | 124/27 |
| 1,328,929 | 1/1920 | McDaniel . | |
| 1,358,125 | 11/1920 | Sturk | 124/29 |
| 2,709,426 | 5/1955 | Nove | 124/481 X |
| 2,725,672 | 12/1955 | Marini | 124/27 X |
| 2,735,221 | 2/1956 | Fields . | |
| 2,964,032 | 1/1959 | Noble | 124/26 |
| 3,009,453 | 11/1961 | Ayala | 124/27 |
| 3,148,478 | 9/1964 | Miller . | |
| 3,726,266 | 4/1973 | Palmer | 42/1.08 X |
| 3,774,586 | 11/1973 | Saito | 124/29 |
| 4,212,412 | 7/1980 | Ikeda | 221/81 |
| 4,834,058 | 5/1989 | Gegere | 124/29 |

*Primary Examiner*—Andrew V. Kundrat
*Assistant Examiner*—John Ricci
*Attorney, Agent, or Firm*—Salter, Michaelson & Benson

[57] ABSTRACT

A toy gun includes a barrel assembly comprising a plurality of side-by-side barrel elements, a plurality of missiles which are receivable in the barrel elements, and a firing assembly for impacting sequential missiles in order to launch them from the barrel assembly. The firing assembly includes a resiliently deflectable firing member and a deflecting mechanism for deflecting and releasing the firing member so that it is resiliently propelled into impacting engagement with sequential missiles for launching the missiles from the barrel assembly.

19 Claims, 5 Drawing Sheets

TOY GUN

BACKGROUND AND SUMMARY OF THE INVENTION

The instant invention relates to toy guns, and more particularly to a toy gun which is operative for launching a plurality of missiles in rapid succession.

Various types of projectile firing toy guns and related devices which are operative for launching toy missiles have been heretofore available and have been found to have significant levels of appeal among children. Further, toy guns and the like which are operative for firing several missiles in rapid succession have been found to have even greater appeal. However, the operating mechanisms of the heretofore available missile firing toys of this type have generally been relatively complicated and unreliable, and hence, they have often been found to be less than satisfactory.

Toy machine guns and other related launching apparatus representing the closest prior art to the subject invention of which the applicant is aware, are disclosed in the U.S. Pat. Nos. to McDaniel No. 1,328,929; Fields No. 2,735,221; Noble No. 2,964,032; Ayala No. 3,009,453; Miller No. 3,148,478; Saito No. 3,774,586; Ikeda No. 4,212,412; and Gegere No. 4,834,058. However, these references fail to suggest a gun which is operative with a simple yet effective and reliable launching mechanism of the type embodied in the toy gun of the instant invention, and hence, they are believed to be of only general interest with respect thereto.

The instant invention provides a toy gun which is operative with a simple, yet effective firing mechanism for reliably launching a plurality of missiles in a relatively rapid succession. More specifically, the toy gun of the instant invention comprises a barrel assembly including a plurality of tubular barrel elements which are disposed in a predetermined sequential array, a plurality of missiles which are receivable in firing positions in sequential barrel elements so that the rear ends of the missiles are positioned adjacent the firing ends of the barrel elements, and a firing mechanism which is operative for sequentially impacting the rear ends of sequential missiles for launching the missile elements from the barrel assembly.

In one embodiment of the toy gun the barrel assembly is mounted on a base, so that the barrel assembly remains substantially stationary as the firing member is sequentially moved into aligned relation with sequential barrel elements for launching the missiles from the barrel assembly In another embodiment of the toy gun the firing member is mounted in a substantially stationary disposition, and the barrel assembly is moved so that sequential barrel elements are sequentially moved into aligned relation with the firing member for launching the missiles from the barrel assembly. In this embodiment the barrel elements preferably have positioning means formed on the inner or firing ends thereof for positioning the missiles adjacent to the firing ends of the barrel elements until the missiles are individually engaged by the firing member. The missiles preferably have rearwardly extending pins on the rear ends thereof which are engageable by the firing member for launching the missiles from the barrel assembly. Further, the missiles are preferably received in missile shells having apertures in the rear ends thereof so that the pins on the missiles extend through the apertures in the rear ends of the respective shells thereof. When the missiles are assembled with the missile shells in this manner, the firing member is operative for engaging the pins of the missiles to launch them from the barrel assembly so that the shells remain in the barrel assembly. Further, this embodiment of the toy gun preferably includes means for sequentially ejecting the shells from the barrel elements after the respective missiles thereof have been launched from the barrel assembly. The means for ejecting the shells preferably includes a plurality of ejecting pins which are engageable with the rear ends of the shells for pivoting them outwardly in their respective barrel elements so that the shells are ejected from the barrel assembly. When the toy gun includes means for ejecting the shells in this manner the barrel assembly preferably includes a cylindrical outer housing having a window therein, and the shells are ejected through the window in the barrel assembly.

It has been found that the toy gun of the instant invention is highly reliable and that it can be effectively embodied in a variety of different toys for launching missiles in rapid succession. Specifically, it has been found that by providing a launching mechanism wherein missiles are sequentially engaged by a resilient firing member as the firing member passes over sequential ramp elements, the missiles can be effectively and reliably launched from the gun of the instant invention. It has been further found that a launching mechanism of this type can be effectively embodied so that a movable firing member is rotated relative to a stationary barrel assembly in order to launch missiles from the barrel assembly. It has been further found that by providing a mechanism for ejecting missile shells from a barrel assembly after missiles have been launched from the shells, the play value of a toy gun of this type can be even further enhanced.

Accordingly, it is a primary object of the instant invention to provide an effective and reliable toy gun which is operative for launching a plurality of missiles in relatively rapid succession.

Another object of the instant invention is to provide an effective toy gun wherein a firing member is moved relative to a plurality of substantially stationary barrel elements in order to launch missiles from the barrel elements.

An even further object of the instant invention is to provide an effective toy gun which is operative for launching missiles from missile shells and which is further operative for ejecting the missile shells after the respective missiles thereof have been launched.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
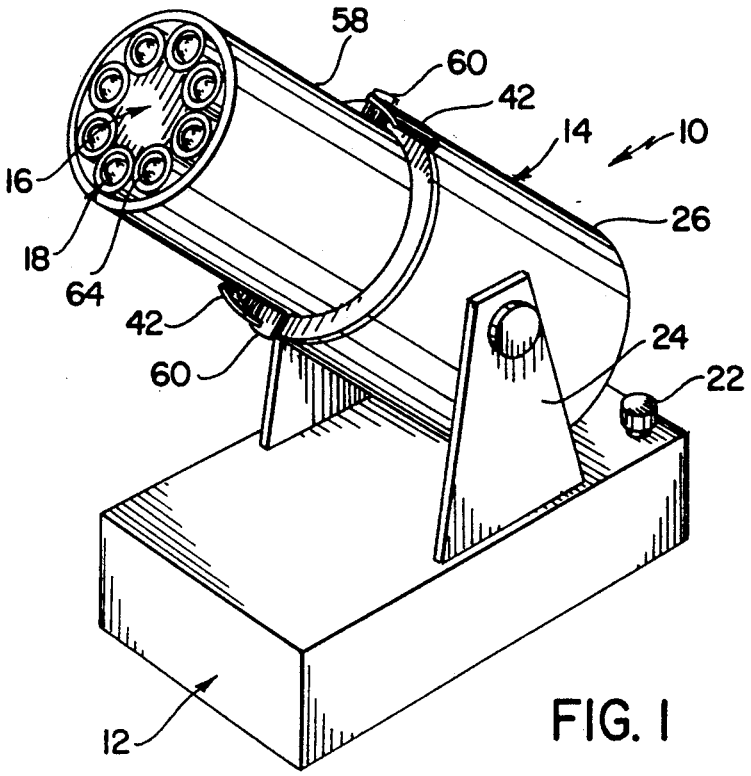
FIG. 1 is a perspective view of a first embodiment of the toy gun of the instant invention.
Figure 2:
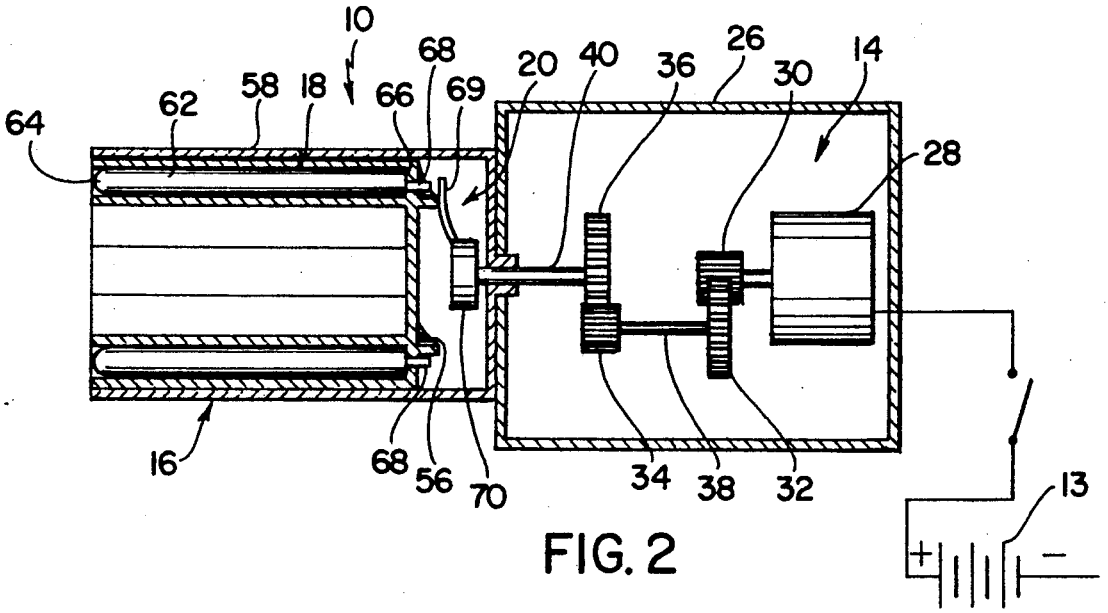
FIG. 2 is a schematic view thereof.

Referring now to the drawings, a first embodiment of the toy gun of the instant invention is illustrated in FIGS. 1 through 4 and generally indicated at 10 in FIGS. 1 and 2. The toy gun 10 comprises a base generally indicated at 12, a battery power supply 13, a drive assembly generally indicated at 14, a barrel assembly generally indicated at 16, a plurality of missile elements generally indicated at 18, and a firing mechanism generally indicated at 20. As illustrated, the firing mechanism 20 and the barrel assembly 16 are mounted on the drive assembly 14, and the drive assembly 14 is mounted on the base 12. Further, the battery power supply 13 is mounted in the base 12, and the base 12 is adapted to be received on a supporting surface for supporting the gun 10 thereon. For operation of the toy gun 10, the missiles 18 are assembled in the barrel assembly 16, and the drive assembly 14 is powered by the battery 13 for rotating the firing mechanism 20 in order to launch the missiles 18 from the barrel assembly 16.

The base 12 is preferably molded from a suitable plastic material and it is adapted for receiving and retaining the battery power supply 13 therein. The battery power supply 13 is of conventional construction and it comprises a plurality of batteries, such as 1.5 volt C cell batteries, which are retained by a suitable means in the base 12. An on/off switch 22 is provided in the upper side of the base 12 for actuating the battery power supply 13 and the drive assembly 14. Also included in the base 12 is a pair of spaced mounting arms 24 which are operative for mounting the drive assembly 14 so that it is pivotable about a substantially horizontal axis.

The drive assembly 14 comprises a cylindrical housing 26 containing a drive motor 28, and first, second, third, and fourth drive gears 30, 32, 34, and 36, respectively. The first drive gear 30 is mounted on the drive motor 28, the second and third gears 32 and 34 are mounted on a shaft 38, and the fourth drive gear 36 is mounted on a shaft 40. The drive gears 30, 32, 34, and 36, are operative for communicating rotation from the drive motor 28 to the shaft 40 so that a predetermined gear reduction is achieved between the rotation of the output shaft of the motor 28 and the output shaft 40. Mounted on the forward end of the housing 26 is a pair of slotted coupling plates 42 for coupling the barrel assembly 16 to the drive assembly 14, as will hereinafter be more fully set forth.

Figure 3:
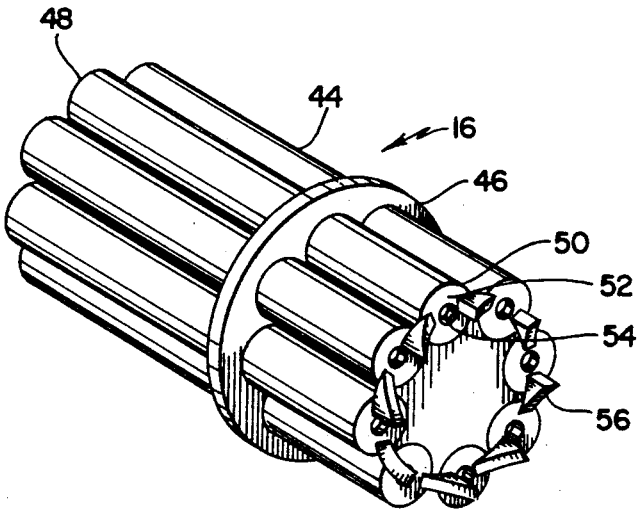
FIG. 3 is a perspective view of the barrel assembly thereof.
Figure 4:
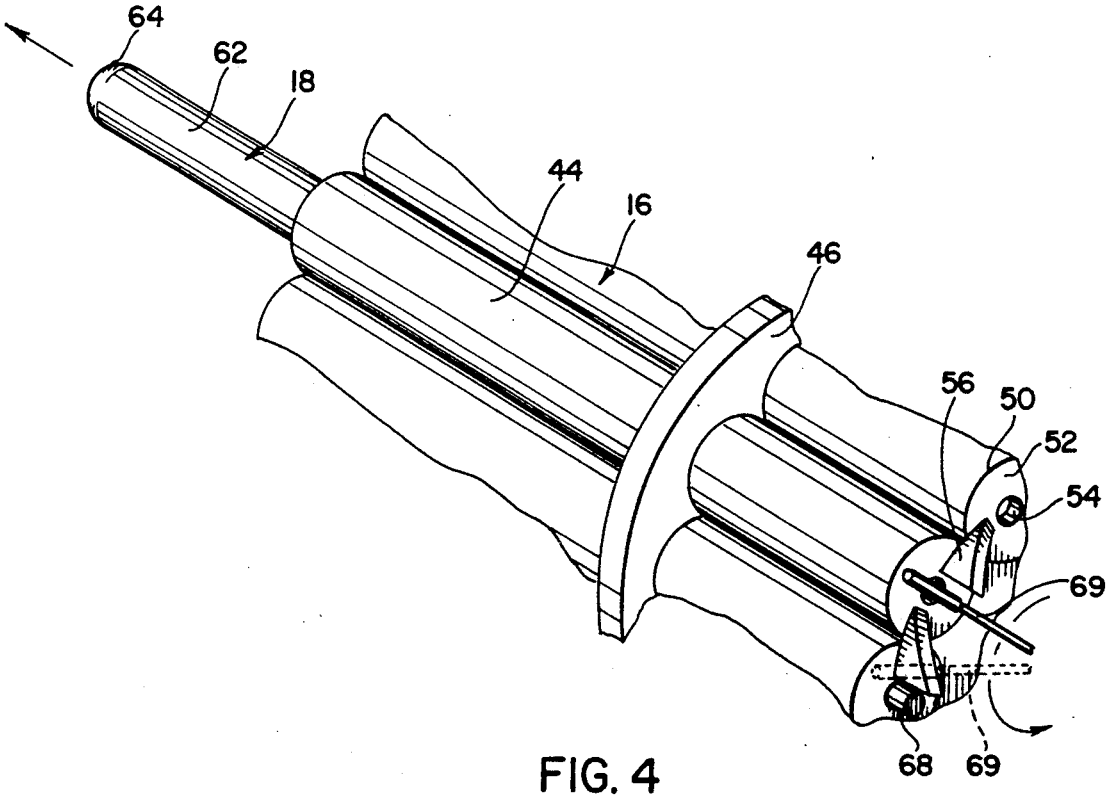
FIG. 4 is an enlarged perspective view of the barrel assembly and the firing member thereof.
Figure 5:
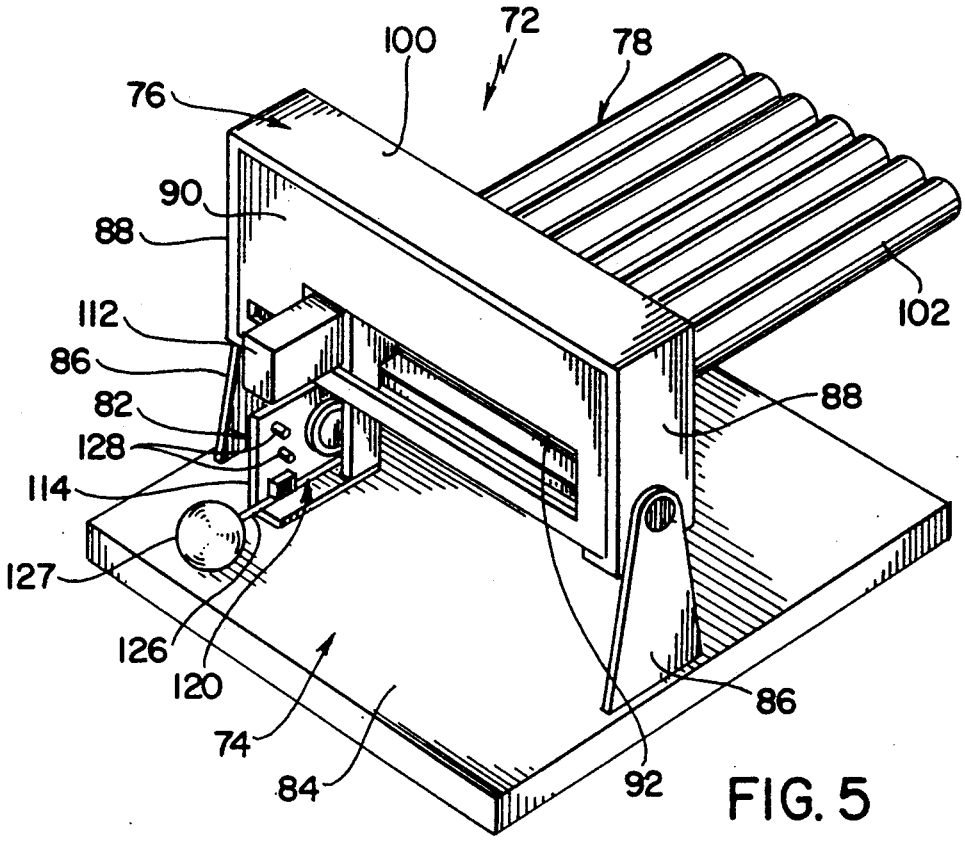
FIG. 5 is a perspective view of a second embodiment of the gun.
Figure 6:
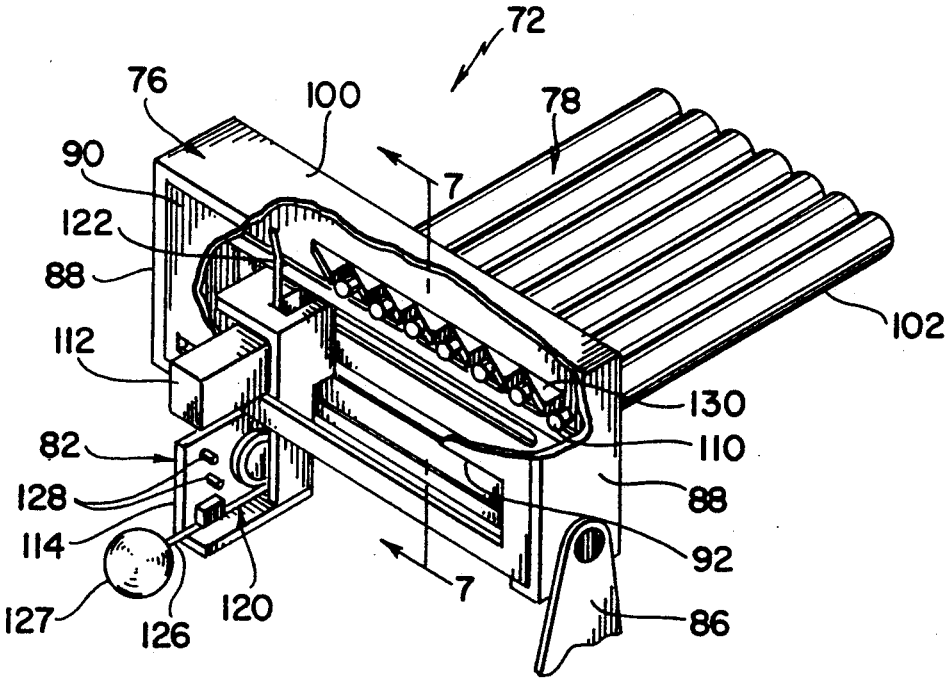
FIG. 6 is a fragmentary perspective view thereof with portions of the housing broken away.

The barrel assembly 16 is illustrated most clearly in FIGS. 3 and 4, and it comprises a plurality of tubular barrel elements 44, and a retaining plate 46. The barrel elements 44 have muzzle ends 48 and firing or breech ends 50, and they are retained in substantially parallel relation by the retaining plate 46 so that the barrel elements 44 cooperate to define a substantially circular ring of substantially parallel barrel elements 44. The barrel elements 44 include end plates 52 on the firing ends thereof, having reduced apertures 54 therein, and ramp elements 56 which actually comprise part of the firing mechanism 20 are provided on the end plates 52. The barrel assembly 16 further includes an open ended cylindrical housing 58 which extends around the barrel elements 44 and has a pair of coupling tabs 60 thereon which are receivable in engagement in slots in the coupling plates 42 for releasably securing the barrel assembly 16 to the drive assembly 14. In this connection, when the barrel assembly 16 is secured to the drive assembly 14 in this manner, it is retained in a substantially stationary disposition relative to the housing 26 of the drive assembly 14.

Each of the missiles 18 comprises an elongated, cylindrical body portion 62 having front and rear ends 64 and 66, respectively, and a pin element 68 which extends rearwardly from the rear end 66 of the body portion 62 thereof. The missiles 118 are dimensioned to be received in the barrel elements 44, so that the body portions 62 thereof are slidably received in the barrel elements 44, and so that the pins 68 thereof extend rearwardly through the apertures 54 in the rear end plates 52 of the barrel elements 44 as illustrated in FIGS. 2 and 4.

The firing mechanism 20 comprises the ramp elements 56 and a resilient firing member 69 which extends outwardly from a center hub 70. The ramp elements 56 are formed in wedge-like configuration, and they are secured on the firing ends 50 of the barrel elements 44 s that they extend between the apertures 54 therein, and so that the upper or raised ends of sequential ramp elements 56 terminate adjacent sequential apertures 54. The firing member 69 comprises a resilient wire element which is biased toward the barrel assembly 16, and the hub 70 is mounted on the shaft 40 for rotating the firing member 69 about the axis of the shaft 40. The shaft 40 is substantially coaxially disposed with respect to the barrel assembly 16, and accordingly, upon rotation of the shaft 40 the firing member 69 is rotated about the axis of the barrel assembly 16. Further, the firing member 69 is positioned so that as the firing member 69 is rotated it engages sequential ramps 56 for camming the firing member 69 rearwardly away from the barrel assembly 44 and then releasing it so that the firing member 69 is resiliently propelled into impacting engagement with the pins 68 of sequential missiles 18 for launching the missiles 18 from the barrel assembly 16.

Accordingly for use and operation of the toy gun 10, the missiles 18 are assembled in the barrel assembly 16 so that the pins 68 thereof extend through the apertures 54 in the end plate 52. The switch 22 is then actuated for energizing the motor 28 to rotate the shaft 40 and the hub 70. As the firing member 69 is rotated about the axis of the shaft 40 by the motor 28 the firing member 69 is cammed outwardly and released by sequential ramp elements 56 so that it is resiliently propelled into impacting engagement with the pins 68 of sequential missiles 18 in order to launch the missiles 18 from the toy gun 10.

A second embodiment of the toy gun of the instant invention is illustrated in FIGS. 5 through 8, and generally indicated at 72. The toy gu 72 comprises a base generally indicated at 74, a main housing generally indicated at 76, a missile assembly generally indicated at 78, a plurality of missiles 80, and a firing mechanism generally indicated at 82. The toy gun 72 is operable by assembling the missiles 80 in the barrel assembly 78, and manually moving the firing mechanism 82 laterally in the housing 76 so that it engages sequential missiles 80 in the barrel assembly 78 for launching the missiles 80 therefrom.

The base 74 comprises a substantially flat base member 84 which is adapted to be received on a supporting surface and a pair of upstanding mounting arms 86 which extend upwardly from the base member 84.

The housing 76 includes a pair of spaced side walls 88 which are received between the arms 86 for mounting the housing 76 on the base 74. The housing 76 further includes a rear wall 90 having an elongated laterally extending slot 92 formed therein and a front wall 94 having a pair of vertically spaced horizontally extending slots 96 formed therein. Further included in the housing 76 is a bottom lip 98, and a top wall 100.

The barrel assembly 78 comprises a plurality of elongated tubular barrel elements 102 which are positioned in a row of side-by-side, substantially parallel, tubular barrel elements 102. The barrel elements 102 further include rear or firing end walls 104, which are integrally formed with the front wall 94 and have reduced apertures 106 formed therein. The barrel elements 102 are assembled with the housing 76 so that they extend outwardly from the front wall 94 thereof, as illustrated.

The missiles 80 are of substantially the same configuration as the missiles 18, and they include elongated cylindrical body portions 108 which are slidably receivable in the barrel elements 102, and rear pin elements 110 which are receivable through the apertures 106 in the rear walls 104 of the barrel elements 102.

Figure 7:
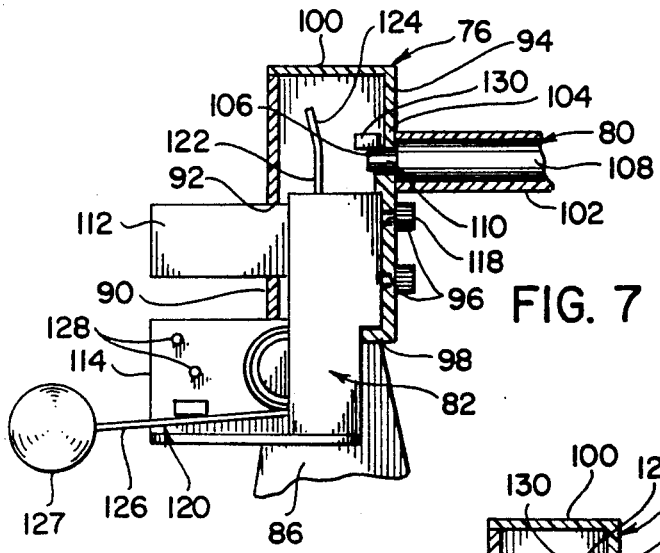
FIG. 7 is a sectional view taken along the line 7—7 in FIG. 6.
Figure 8:
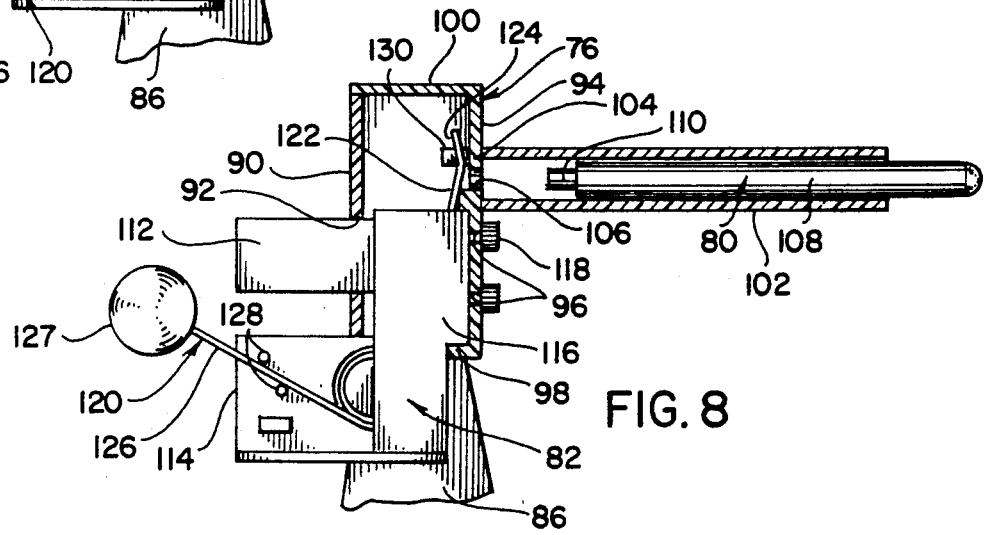
FIG. 8 is a similar sectional view illustrating the operation of the firing mechanism.
Figure 9:
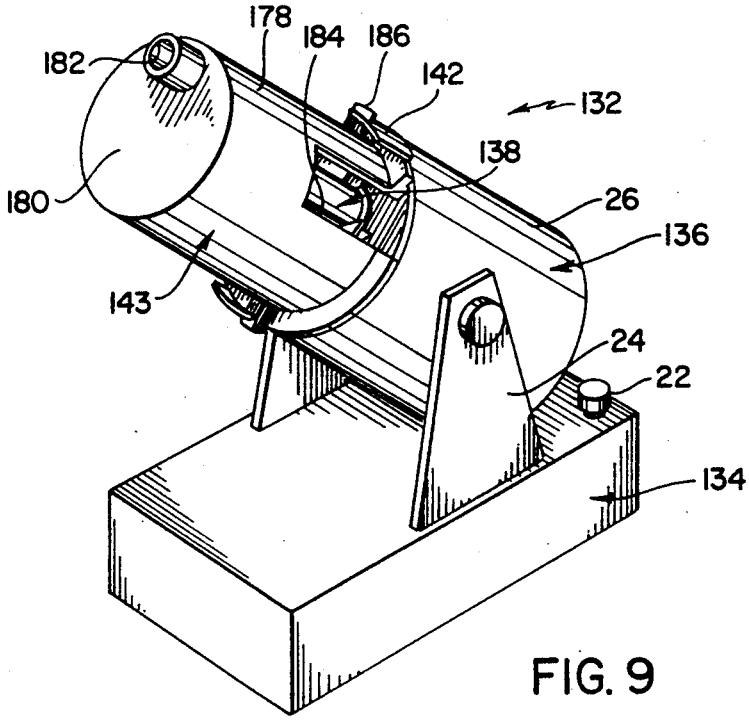
FIG. 9 is a perspective view of a third embodiment of the toy gun.

The firing mechanism 82 is disposed in the housing 76, and it comprises a slide block 112, which is slidably received in the slot 92 in the rear wall 90, a spring plate 114, and a connector plate 116 which extends between the spring plate 114 and the slide block 112. The connector plate 116 is slidably secured to the front wall 94 with screws 118 which extend through the slots 96, and a torsion spring generally indicated at 120 is assembled with the spring plate 114. The torsion spring 120 includes first and second legs which extend outwardly from a center coil portion to define an angle of approximately 90° therebetween. In this regard, the first leg of the torsion spring 120 defines a firing member 122 having a slightly bent terminal end portion 124, and the second leg Of the torsion spring 120 defines a handle arm 126 having a handle element 127 thereon. As illustrated in FIGS. 7 and 8, the torsion spring 120 is pivotable between the first position illustrated in FIG. 7, wherein the firing member 122 is spaced rearwardly from the front wall 94 and the second position illustrated in FIG. 8, wherein the firing member 122 is positioned in closely adjacent relation to the front wall 94 and biased toward a position of engagement therewith as a result of the handle arm portion 126 being pivoted upwardly to position the firing member 122 and the handle arm 126 at a slightly reduced angle. The handle arm portion 126 is releasably securable in the second position thereof by wedging it between a pair of pins 128 on the spring plate 114 so that it is positioned in the manner illustrated in FIG. 8. The firing mechanism 82 further comprises a plurality of wedge elements 130 on the rear side of the front wall 94. The wedge elements 130 are positioned so that they extend between the apertures 106 at the rear end of the barrel elements 102, and hence, they are operative for sequentially camming the firing member 122 rearwardly and then releasing it so that the firing member 122 is sequentially resiliently propelled into impacting engagement with sequential pins 110 on the rear ends of the missiles 80 located in sequential barrel elements 102.

Accordingly, for operation of the toy gun 72, the missiles 80 are assembled in the barrel elements 102 so that the pins 110 of the missiles 80 extend rearwardly through the apertures 106 at the rear ends of the barrel elements 102, and the firing mechanism 82 is moved to the extreme left end of the housing 76. In this connection, before moving the firing mechanism 82 to the left end of the housing 76 the torsion spring 120 must be moved to the first position thereof illustrated in FIG. 7, so that the firing member 122 is moved rearwardly away from the ramps 30 and the front wall 94. This allows the firing member 122 to be advanced to the left end of the housing 76 with the remainder of the firing mechanism 82 without contacting the ramps 130. The torsion spring 120 is then moved to the second position thereof illustrated in FIG. 8 by moving the handle element 128 upwardly so that the handle arm 126 is positioned between the pins 128. The firing mechanism 82 can then be slidably moved to the right side of the housing 76 to cause the firing member 122 to be repetitively cammed away from the wall 94 and released by the ramps 128 so that it is resiliently propelled into impacting engagement with the pins 110 of sequential missiles 80. As a result, as the firing mechanism 82 is advanced toward the right side of the housing 76 the missiles 80 are sequentially propelled outwardly from sequential barrel elements 102.

Referring now to FIGS. 9 through 12, a third embodiment of the toy gun of the instant invention is illustrated and generally indicated at 132. The toy gun 132 comprises a base portion generally indicated at 134, a drive assembly generally indicated at 136, a barrel assembly generally indicated at 138, a plurality of missile cartridges generally indicated at 140, a firing mechanism generally indicated at 142, and a housing 143. The missile cartridges 140 comprise missiles 144 and tubular shells 146, and they are adapted to be assembled in the barrel assembly 138. The barrel assembly 138 is mounted on the drive mechanism 136 which is in turn mounted on the base 134. During operation of the toy gun 142, the drive mechanism 136 is operative for rotating the barrel assembly 138 so that sequential missiles 144 are fired from the barrel assembly 138 with the firing mechanism 142, and so that the corresponding shells 146 thereof are sequentially ejected from the barrel assembly 138.

The base 134 is essentially identical to the base 12 of the toy gun 10, and it includes means for containing a battery power supply (not shown), a push-button on/off switch 22, and a pair of spaced, upstanding mounting arms 24.

The drive assembly 136 is similar to the drive assembly 14 of the toy gun 10, with the exception that it includes a drive shaft 148 of substantially square cross section which extends outwardly from a hub 150. The drive assembly 132, however, includes a drive motor 28, gears 30, 32, 34, and 36, and a shaft 38, all of which are identical to the corresponding components of the toy gun 10. The drive shaft 148 is attached to the gear 36 of the drive assembly 136, so that the drive shaft 148 is rotated whenever the motor 28 is energized. The drive assembly 136 further includes a housing 26 which is received in the mounting arms 24 of the base 134, and a pair of slotted attachment plates 42 on the housing 26.

The barrel assembly 138 is rotatable in the barrel assembly housing 143 and it comprises a plurality of barrel elements 152 which are retained in assembled relation with a pair of retaining plates 154 and a firing end plate 155, so that the barrel elements 152 are disposed in a substantially circular ring of substantially parallel barrel elements 152. The firing end plate 155 has a substantially square socket **155*b* formed therein for receiving the drive shaft 148 in order to rotate the barrel assembly 138 with the drive assembly 132. Each of the barrel elements 152 is open at the breech or firing end thereof, and the rear half of each of the barrel elements 152 is formed with an open area 156. Further, the rear inner extremity of each of the barrel elements 152 is formed with a beveled or flaired edge 158**.

As is hereinabove set forth, the missile cartridges 140 each comprises a missile 144 and a tubular shell 146. Each of the missiles 144 includes an elongated, rearwardly extending pin 160, and each of the shells 146 includes a slightly enlarged rear end wall 161 which forms a slightly outwardly projecting peripheral flange on the rear end of the shell 146 thereof. Further, each of the end walls 161 has a reduced aperture 162 therein. The missile cartridges 140 are adapted to be assembled so that the missiles 144 are received in assembled relation with the shells 146, so that the main or forward portions of the missiles 144 extend outwardly from the respective shells 146 thereof, and so that the pins 160 thereof extend rearwardly through the shells 146 thereof and outwardly through the respective apertures 162 thereof slightly beyond the respective end walls 161 thereof.

Figure 10:
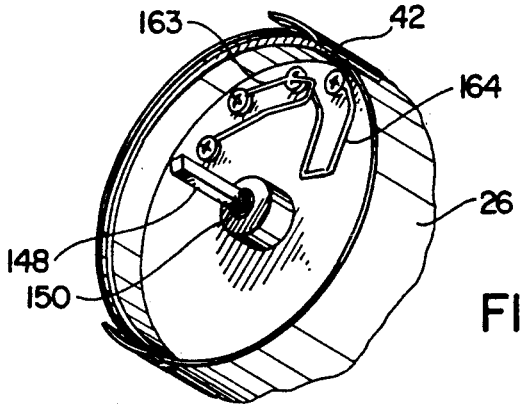
FIG. 10 is a fragmentary perspective view of the rotating mechanism thereof.
Figure 11:
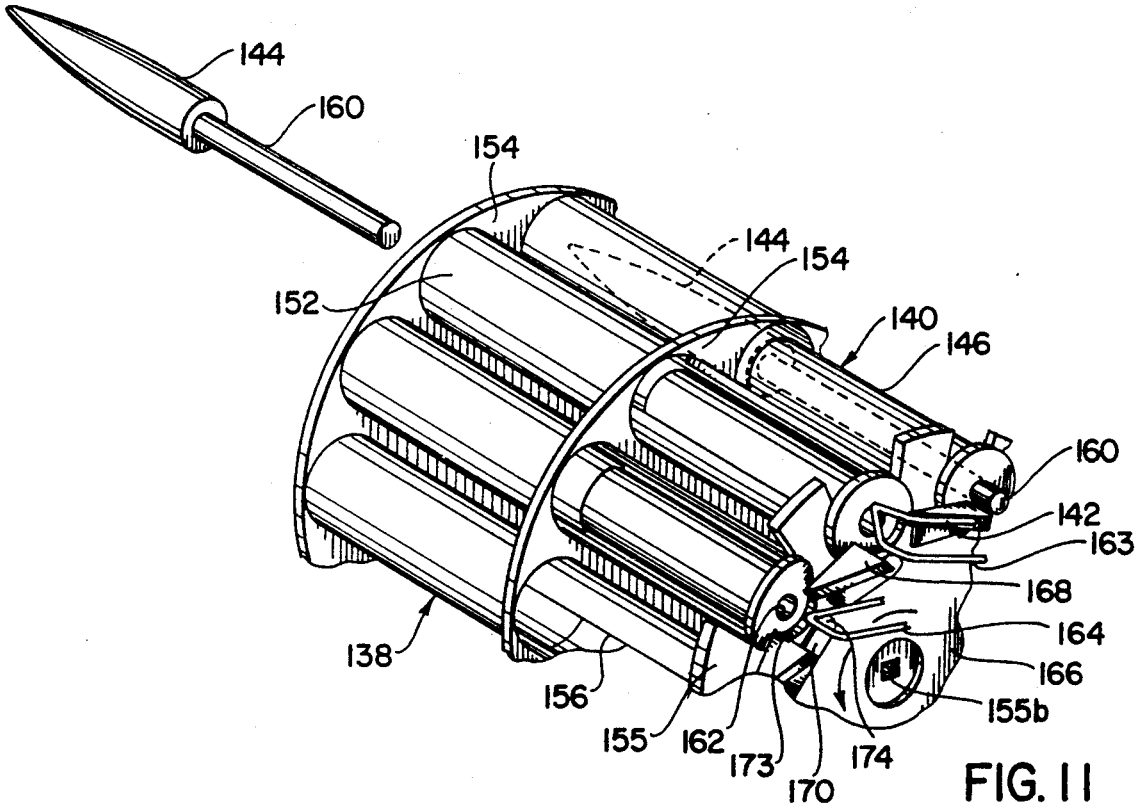
FIG. 11 is an enlarged fragmentary perspective view of the barrel assembly and firing mechanism thereof.
Figure 12:
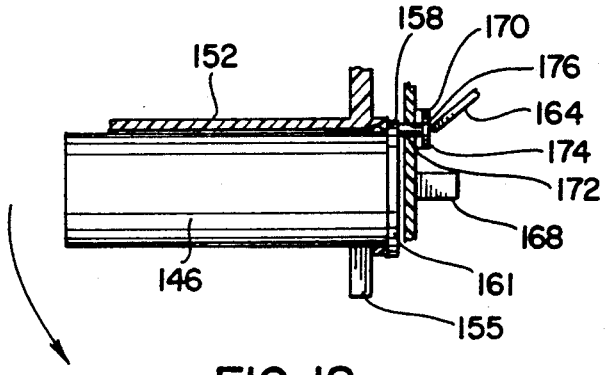
FIG. 12 is a fragmentary sectional view illustrating the operation of the ejecting mechanism thereof.

The firing mechanism 142 is illustrated in FIGS. 10 through 12, and it comprises a firing member 163, an ejecting member 164, a generally circular mounting plate 166, a plurality of ramps 168 and a plurality of ejecting arms 170 having ejecting pins 172 thereon. The mounting plate 166 is mounted on the breech or firing end of the barrel assembly 138, and it has a plurality of semicircular peripheral notches 173 formed therein which are substantially co-axially oriented with respect to the barrel elements 152. The ramp elements 168 are formed in wedge-like configuration and they are mounted on the mounting plate 166 so that they extend between the notches 173. The firing member 163, which is mounted on the forward end of the drive assembly 136, is formed and positioned so that it is substantially aligned With the path of the ramps 168 as the barrel assembly 138 is rotated. Further, the firing member 163 is biased toward the breech or firing end of the barrel assembly 138, and accordingly, the outer end of the firing member 163 is sequentially cammed rearwardly and released by sequential ramp elements 168 so that it repetitively snaps forward as the barrel assembly 138 is rotated. Accordingly, when the cartridge assemblies 140 are assembled in the barrel assembly 138 so that the rear ends of the pins 160 extend outwardly beyond the respective rear end plates 161 thereof, the firing member 163 is resiliently propelled into impacting engagement with the rear ends of sequential pins 160 of the missiles 144 to propel the missiles 144 outwardly from the barrel assembly 138.

The ejecting member 164, the ejecting arms 170, and the ejecting pins 172, are operative for ejecting sequential shells 146 from the barrel assembly 138 once the respective missiles 144 thereof have been launched from the barrel assembly 138. The ejecting member 164 comprises a resilient wire element and it is positioned so that the terminal end thereof is aligned with the breech end of the particular barrel element 146 which immediately precedes the barrel element 146 aligned with the firing member 163. In other words, during operation of the gun 132 each barrel element 146 is first moved to a position of alignment with the firing member 163 and immediately thereafter moved to a position of alignment with the ejecting member 164. The ejecting arms 170 are constructed so that they are slightly resiliently deflectable, and they are mounted on the mounting plate 166 so that they are positioned slightly inboard of the ramp elements 168. The ejecting arms 170 include free terminal end portions 174 which are aligned with reduced apertures 176 in the mounting plate 166, and the ejecting pins 172 are secured to the ejecting arms 170 so that they travel in the apertures 176. The ejecting arms 170 are connected to the plate 166 so that they are slightly pivotable forwardly relative thereto, and the terminal end portions 174 of the arms 170 are positioned adjacent the notches 173. Hence, as the barrel assembly 138 is rotated, the ejecting member 164 is cammed rearwardly and then released by the ramps 168, and each time the ejecting member 164 is released it is resiliently propelled forwardly into impacting engagement with the terminal end portion 174 of one of the ejecting arms 170 to drive the respective ejecting pin 172 thereof forwardly. In other words, during operation of the gun 132, each barrel element 146 is first moved to a position of alignment with the firing member 163 and immediately thereafter moved to a position of alignment with the ejecting member 164. In this regard, because the ejecting member 164 is resiliently propelled forwardly as it is sequentially released by sequential ramps 168, the ejecting member 164 is operative for sharply engaging the ejecting arms 170 so that the pins 172 sharply engage the respective shells 146 thereof to more effectively eject the shells 146 outwardly from the barrel assembly 138.

The barrel assembly housing 143 is of generally cylindrical configuration and it includes a cylindrical outer side wall 178 and a front end wall 180. A tubular firing muzzle 182 is formed in the end wall 180 so that the muzzle 182 is substantially aligned with the terminal end portion of the firing member 163. As a result, when the firing member 163 engages the pin 160 of one of the missile elements 144, the missile element 144 is propelled outwardly and launched through the muzzle 182. Also formed in the housing 143 is a side window 184 which is positioned adjacent the particular barrel element 152 which is aligned with the ejecting member 164. Accordingly, when the ejecting member 164 engages one of the ejecting arms 170 for ejecting one of the shells 146, the shell 146 can pass outwardly through the window 184 as it is ejected from the barrel assembly 138. The housing 143 further includes a pair of attachment tabs 186 for securing the housing 143 and the barrel assembly 138 to the drive assembly 136 with the attachment plates 42.

For use and operation of the toy gun 132, the cartridge assemblies 140 are assembled in the barrel elements 152 so that the pin elements 160 project rearwardly through the end plates 161 and so that the end plates 161 are positioned adjacent the plate 166. The switch 22 on the base 134 is then depressed to energize the drive assembly 136 for rotating the barrel assembly 138 in the housing 143. As the barrel assembly 138 is rotated, the firing member 163 is cammed rearwardly by sequential ramp elements 168, and then resiliently propelled forwardly into impacting engagement with the pin element 160 of the missile 144 aligned therewith to launch the missile 144 outwardly through the muzzle 182. As the barrel assembly 138 is rotated further, the ejecting member 164 is cammed rearwardly and then released so that it is propelled into impacting engagement with the adjacent ejecting arm 170. As a result, the ejecting pin 172 associated with the ejecting arm 170 is propelled forwardly into engagement with the end plate 161 of the adjacent shell 146 so that the shell 146 is pivoted outwardly on the beveled surface 158 to eject the shell 146 from the barrel assembly 138.

It is seen therefore that the instant invention provides an effective toy gun which is operative for launching a plurality of missiles in relatively rapid succession. The toy guns 16 and 72 are operative for rapidly launching missiles from substantially stationary barrel assemblies utilizing movable launching mechanisms, whereas the gun 132 is operative for launching missiles 144 from a rotating barrel assembly 138. The toy gun 132 is further operative for launching missiles 144 from missile shells 146, and for ejecting the shells 146 from the barrel assembly 138 once the missiles 144 have been launched. In any case, the guns 10, 72, and 132, are operative with relatively simple and reliable mechanisms so they can be effectively utilized for launching missiles in rapid sequence. Accordingly, it is seen that the instant invention represents a significant advancement in the toy art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A toy gun comprising a barrel assembly having opposite firing and muzzle ends and including a predetermined sequential array of a plurality of substantially parallel, tubular barrel elements, each of said barrel elements having opposite firing and muzzle ends which correspond to the firing and muzzle ends of said barrel assembly, respectively, a plurality of missile elements having front and rear ends and slidably receivable in sequential barrel elements so that the rear ends of said missile elements are positioned adjacent the firing ends of the respective barrel elements thereof, a base receivable on a supporting surface for supporting said barrel assembly thereon, said barrel assembly being mounted on said base so that said barrel assembly remain substantially stationary relative thereto during the launching of said missiles, and firing means for sequentially firing the missile elements from sequential barrel elements, said firing means including a firing member and means for moving said firing member so that it sequentially engages the rear ends of the missile elements in sequential barrel elements for launching said missile elements from said barrel assembly.

2. In the toy gun of claim 1, said barrel assembly being of substantially cylindrical configuration, said barrel elements being disposed in substantially parallel relation to the cylindrical configuration of said barrel assembly, and positioned to form a substantially circular ring of said barrel elements.

3. The toy gun of claim 1, further comprising a plurality of shell elements, each of said missile elements being receivable in a shell element to form a missile cartridge, said missile cartridges being receivable in said barrel elements, each of said shell elements having a rear end having an aperture therein, each of said missile elements including a rearwardly extending pin element, each of said pin elements being receivable through the aperture in the rear end of the respective shell element thereof, said firing member engaging said pin elements for launching said missile elements from said barrel assembly.

4. The toy gun of claim 3, further comprising ejecting means for sequentially individually laterally ejecting said shell elements once the respective missile elements thereof have been launched from said barrel assembly.

5. The toy gun of claim 4, further comprising an outer barrel assembly housing having a side window therein, said ejecting means ejecting said shell elements through said side window.

6. In the toy gun of claim 3, each of said shell elements being pivotable outwardly in the respective barrel element thereof at a predetermined position in the rotation of said barrel assembly, said ejecting means comprising means for individually engaging the rear ends of said shell elements to individually pivot said shell elements outwardly when they are in said predetermined position in order to thereby eject said shell elements from said barrel assembly, each of said barrel elements having a side opening therein adjacent the respective rear end thereof, said shell elements being ejected through the side openings in the respective barrel elements thereof.

7. In the toy gun of claim 6, said means for individually engaging the rear ends of said shell elements comprising a plurality of ejecting pins on the rear end of said barrel assembly, one of said ejecting pins being engageable with each of said shell elements when said shell elements are received in said barrel elements for ejecting said shell elements from said barrel assembly.

8. In the toy gattling gun of claim 7, each of said shell elements having a rear end flange thereon, each of said ejector pins being engageable with the rear end flange of the respective shell element thereof for pivoting the shell element thereof outwardly in order to eject said shell elements from said barrel assembly.

9. In the toy gun of claim 7, said means for individually engaging the rear ends of said shell elements comprising a plurality of ramp elements on the firing end of said barrel assembly and a resilient ejecting member, said resilient ejecting member traveling over said ramp elements and engaging sequential ejecting pins for ejecting said shell elements from said barrel assembly.

10. A toy gun comprising a barrel assembly having opposite firing and muzzle ends, and including a predetermined sequential array of a plurality of substantially parallel tubular barrel elements, each of said barrel elements having opposite firing and muzzle ends which correspond to the muzzle and firing ends of said barrel assembly, respectively, a plurality of missile cartridges each including shell elements and missile elements removably received in the respective shell element thereof, each of said shell elements having front and rear ends and having a reduced aperture in the rear end thereof, each of said missile elements having front and rear ends and including a pin extending rearwardly from the rear end thereof, said missile elements being receivable in the respective shell elements thereof so that the pins of said missile elements extend rearwardly through the apertures in the respective shell elements thereof, said missile cartridges being receivable in firing positions in sequential barrel elements so that the rear ends of said missile elements are positioned adjacent the firing ends of the respective barrel elements thereof, and means for engaging the pins of the missile elements of the missile cartridges located in sequential barrel elements for launching said missile elements from said barrel assembly.

11. The toy gun of claim 10 further comprising means for ejecting the shell elements from sequential barrel elements after the respective missile elements thereof have been launched from said barrel assembly.

12. A toy gun comprising a barrel assembly having opposite firing and muzzle ends, and including a predetermined sequential array of a plurality of substantially parallel tubular barrel elements, each of said barrel elements having opposite muzzle and firing ends which correspond to the muzzle and firing ends of said barrel assembly, respectively, said barrel assembly being of substantially cylindrical configuration and having a longitudinal axis, said barrel elements being disposed in side-by-side relation and in substantially parallel relation to the cylindrical configuration of said barrel assembly, said barrel elements being positioned to form a substantially circular ring of barrel elements, a plurality of missible elements having front and rear ends and slidably receivable i firing positions is sequential barrel elements wherein the rear ends of said missible elements are positioned adjacent the firing ends of the respective barrel elements thereof and firing means for sequentially firing the missile elements from sequential barrel elements, said firing means including a resiliently bendable firing member resiliently movable into impacting engagement with the missile elements in sequential barrel elements when said missile elements are received therein, and means for resiliently bending and releasing said firing member so as to cause the latter to be resiliently moved into impacting engagement with the rear ends of the missile elements located at the firing ends of sequential barrel elements for launching said missile elements when they are received in said barrel elements, said firing member pivoting about the longitudinal axis of said barrel assembly for lauching said missile elements.

13. In the toy gun of claim 12, said means for sequentially bending and releasing said firing member comprising a plurality of ramp elements on the firing end of said barrel assembly, said firing member being sequentially bent away from the firing end of said barrel assembly and then released, so that it is resiliently moved into impacting engagement with sequential missile elements for launching said missile elements.

14. In the toy gun of claim 12, said means for sequentially bending and releasing said firing member comprising a plurality of ramp elements on the firing end of said barrel assembly, said firing member being repetitively bent away from the firing end of said barrel assembly by said ramp elements and then released so that said firing member is resiliently moved into impacting engagement with sequential missile elements for launching said missile elements from said barrel assembly.

15. A toy gun comprising a barrel assembly having opposite firing and muzzle ends, and including a predetermined sequential array of a plurality of substantially parallel tubular barrel elements, each of said barrel elements having opposite nuzzle and firing ends which correspond to the muzzle and firing ends of said barrel assembly, respectively, a plurality of missile elements having front and rear ends and slidably receivable in firing positions in sequential barrel elements wherein the rear ends of said missile elements are positioned adjacent the firing ends of the respective barrel elements thereof and firing means for sequentially firing the missile elements from sequential barrel elements, said firing means including a resiliently bendable firing member resiliently movable into impacting engagement with the missile elements in sequential barrel elements when said missile elements are received therein, means for resiliently bending and releasing said firing member so as to cause the latter to be resiliently moved into impacting engagement with the rear ends of the missile elements located at the firing ends of sequential barrel elements for launching said missile elements when they are received in said barrel elements, and a base receivable on a supporting surface for supporting said barrel assembly thereon, said barrel assembly being mounted on said base so that the former remains substantially stationary relative thereto during launching of said missile elements, said firing member moving relative to said barrel assembly for positioning said firing member in substantially aligned relation with the rear ends of sequential barrel elements.

16. In the toy gun of claim 15, said barrel assembly being of substantially cylindrical configuration and having a longitudinal axis, said barrel assembly being mounted on said base so that said barrel assembly is non-rotatable about the longitudinal axis thereof relative to said base, said firing member pivoting about the longitudinal axis of said barrel assembly for launching sequential missile elements.

17. In the toy gun of claim 16, said means for sequentially bending and releasing said firing member comprising a plurality of ramp elements on the firing end of said barrel assembly, said firing member being repetitively bent away from the firing end of said barrel assembly by said ramp elements and then released, so that said firing member is resiliently moved into impacting engagement with sequential missile elements for launching said missile elements.

18. The toy gun of claim 16 further comprising drive means actuatable for automatically pivoting said firing member about said axis.

19. A toy gun comprising a barrel assembly having opposite firing and muzzle ends, and including a predetermined sequential array of a plurality of substantially parallel tubular barrel elements, each of said barrel elements having opposite muzzle and firing ends which correspond to the muzzle and firing ends of said barrel assembly, respectively, a plurality of missile elements having front and rear ends of slidably receivable in firing positions in sequential barrel elements wherein the rear ends of said missile elements are positioned adjacent the firing ends of the respective barrel elements thereof and firing means for sequentially firing the missile elements from sequential barrel elements, said firing means including a resiliently bendable firing member resiliently movable into impacting engagement with the missile elements in sequential barrel elements when said missile elements are received therein, and means for resiliently bending and releasing said firing member so as to cause the latter to be resiliently moved into impacting engagement with the rear ends of the missile elements located at the firing ends of sequential barrel elements for launching said missile elements when they are received in said barrel elements each of said barrel elements including positioning means at the firing end thereof for positioning the respective missile element thereof in a predetermined firing position therein, each of said missile elements having a reduced pin on the rear end thereof, each of said pins extending rearwardly through the rear end of the respective barrel element thereof when said missile elements are received in said barrel elements, said firing member engaging said pins for launching said missile elements from said barrel assembly.

* * * * *